United States Patent [19]

Minter

[11] Patent Number: 4,583,333

[45] Date of Patent: Apr. 22, 1986

[54] ROOM ADDITION CONSTRUCTION

[75] Inventor: Mearl Minter, Oskaloosa, Iowa

[73] Assignee: Rolscreen Company, Pella, Iowa

[21] Appl. No.: 448,634

[22] Filed: Dec. 10, 1982

Related U.S. Application Data

[63] Continuation-in-part of Ser. No. 270,822, Jun. 5, 1981, abandoned.

[51] Int. Cl.[4] ..... E04B 7/02; E04C 1/34

[52] U.S. Cl. ..... 52/90; 52/58; 52/92; 52/262; 52/282; 52/461; 52/465

[58] Field of Search ..... 52/90, 92, 79.6, 79.7, 52/282, 772, 469, 460, 461, 463, 466, 467, 235, 416, 417, 395, 465, 471, 403, 744, 262, 58 S; 47/17

[56] References Cited

U.S. PATENT DOCUMENTS

| | | | |
|---|---|---|---|
| D. 245,996 | 10/1977 | Lukens | D25/15 |
| 980,433 | 1/1911 | Phillips . | |
| 2,106,140 | 1/1938 | Strong | 52/465 |
| 2,281,071 | 4/1942 | Knudsen . | |
| 2,501,418 | 3/1950 | Snowden, Jr. | 52/171 |
| 2,545,907 | 3/1951 | Watkins . | |
| 2,595,905 | 5/1952 | Telkes . | |
| 2,873,486 | 2/1959 | Hughes . | |
| 2,877,516 | 3/1959 | Bobel . | |
| 2,976,583 | 3/1961 | McCarthy | 52/475 |
| 3,008,196 | 11/1961 | Springer et al. . | |
| 3,022,549 | 2/1962 | Cummings . | |
| 3,129,471 | 4/1964 | Johnson et al. . | |
| 3,148,479 | 9/1964 | D'Amato . | |
| 3,265,117 | 8/1966 | Lorentzen | 160/174 |
| 3,324,620 | 6/1967 | Requena . | |
| 3,562,972 | 2/1971 | D'Amato | 47/17 |
| 3,762,109 | 10/1973 | Cohen | 52/11 |
| 3,860,055 | 1/1975 | Wild | 160/1 |
| 3,987,597 | 10/1976 | Smrt | 52/495 |
| 4,018,213 | 4/1977 | Mann, Jr. | 126/271 |
| 4,027,437 | 6/1977 | Monsky | 52/2 |
| 4,057,841 | 11/1977 | Schwartz | 52/63 |
| 4,068,421 | 1/1978 | Marovich | 52/80 |
| 4,069,627 | 1/1978 | Pegg | 52/92 |
| 4,075,811 | 2/1978 | Keith | 52/395 |
| 4,076,013 | 2/1978 | Bette | 126/270 |
| 4,114,330 | 9/1978 | Sukolics | 52/772 |
| 4,127,103 | 11/1978 | Klank et al. | 126/271 |
| 4,145,855 | 3/1979 | Sheldon | 52/232 |
| 4,173,855 | 11/1979 | Raptoplous | 52/82 |
| 4,201,019 | 5/1980 | Jones | 52/15 |
| 4,212,289 | 7/1980 | Hebert | 126/428 |
| 4,219,008 | 8/1980 | Schultz | 126/419 |
| 4,251,964 | 2/1981 | Francis | 52/282 |

FOREIGN PATENT DOCUMENTS

| | | | |
|---|---|---|---|
| 2143171 | 3/1973 | Fed. Rep. of Germany | 52/469 |
| 2518048 | 3/1976 | Fed. Rep. of Germany | 52/465 |
| 533128 | 2/1941 | United Kingdom | 160/84 R |
| 1529021 | 10/1978 | United Kingdom | 47/17 |
| 676704 | 8/1979 | U.S.S.R. | 52/393 |

OTHER PUBLICATIONS

Janco Greenhouses, 1968, J. A. Nearing Co., Inc., pp. 12–13.

Sunlyt Home Greenhouse, Lord and Burhham, pp. 1–4, Jun. 2, 1976.

Pella Sunroom, James A. Cassidy Co., Inc.

EZRected Lean-To, p. 16, Texas Greenhouse Co., Inc., 6/10/76.

Everlite Aluminum Greenhouses, Inc., pp. 1–9, Oct. 1975.

*Primary Examiner*—Donald G. Kelly

*Assistant Examiner*—Jean M. LaKemper

*Attorney, Agent, or Firm*—Zarley, McKee, Thomte, Voorhees & Sease

[57] ABSTRACT

A room addition type of construction for attachment to the outside wall of a building. The wall has an opening for access to the interior of the building. A foundation is provided adjacent the wall and an upright frame assembly is mounted on the foundation. The frame includes side wall frames, an outer wall frame, and a roof frame. A plurality of structurally independent panel members are securely mounted in each of the frame portions with a substantial portion of the panels comprising window units having glazing panels therein. The panel members cooperate with the frame assembly for providing load bearing support for the structure. The frame assembly is secured to the building and a weather seal is provided between the room structure assembly and the building. The panels are secured to each other and to the frame assembly and weather seals are provided between the panels and between the panels and the frame assembly.

29 Claims, 16 Drawing Figures

ROOM ADDITION CONSTRUCTION

CROSS-REFERENCE TO RELATED APPLICATION

This application is a continuation-in-part of U.S. patent application Ser. No. 270,822 for "Room Addition Construction", filed on June 5, 1981 and now abandoned.

BACKGROUND OF THE INVENTION

Field of the Invention and Description of the Prior Art

This invention relates to a structural assembly that may be attached to the exterior wall of an existing or new building and it particularly relates to a room addition assembly, having a high proportion of windows, that may be attached to the wall of a building.

There is always a need for high-quality construction, including that for additions to existing buildings. In a similar way, there is always an existing need to have such high-quality construction be economical. This is particularly true during inflationary conditions, such as those that exist today. Because of the high cost of housing, many people are now choosing to add on to their present houses rather than seek out newer, larger homes. In essence, there is a particularly acute need for high-quality but economical construction, particularly for room additions and the like.

Another significant need that has arisen in the past several years is the need for energy efficient construction. One of the great relatively unused sources of energy useful for heat is solar heat. Particularly during the winter months, solar energy is considered to be highly useful for heating rooms, including room additions. This is generally accomplished by providing a large amount of window space in a room, including that of a room addition in order to heat by passive solar energy. Therefore, in summary, clearly, there is an acute existing need for high-quality, economical, energy efficient construction, particularly construction that may be useful as a room addition for an existing building, including residences.

SUMMARY OF THE INVENTION

It is therefore an important object of the present invention to provide a unique room addition structural assembly which is characterized by its simplicity and economy of construction, by its high-quality construction, and by its energy efficiency in design.

It is also an object of the present invention to provide a unique room addition structural assembly, wherein the assembly is substantially pre-constructed and designed to be attached to the exterior wall of an existing structure, such as a house, and wherein the exposed exterior walls and roof are comprised principally of window units with glazing panels therein.

It is another object of the present invention to provide a room addition structure assembly which is designed to utilize solar energy for the heating thereof by providing a high proportion of window space for access of the sun rays so as to accomplish heating by solar energy, while, at the same time, the structure selectively utilizes a plurality of slat shades to block sun rays, particularly during warm or hot weather and thereby reduce cooling load required for an air conditioning unit.

It is still object of the present invention to provide a room structure assembly which is characterized by its uniqueness in construction by providing a plurality of window units with glazing panels, which are provided both on the side walls and on the roof, the window units acting as load bearing members to provide simplicity and economy of construction for the assembly.

It is still another object of the present invention to provide a room addition assembly which is constructed of a plurality of window units with glazing panels therein, which not only function as load bearing members, but which include members for securing the panels to each other and to a surrounding frame structure and also include seals to provide a substantially weather tight room assembly.

Further purposes and objects of the present invention will appear as the specification proceeds.

The foregoing objects are accomplished by providing a unique room addition type of assembly which may be attached to the exterior wall of an existing building, such as a residence, the wall having an opening therein for providing access between the interior of the building and the room structure, a foundation being positioned adjacent the wall, an upright frame mounted on the foundation, the frame including a pair of spaced side wall frame portions, an outer wall frame portion, and a roof frame portion, a plurality of structurally independent, pre-constructed panel members which are securely mounted in each of the frame portions, a substantial proportion of the panels comprising window unit assemblies having glazing panels therein, the roof of the structure particularly including a substantial portion of panel members with glazing panels therein, said panel members cooperating with the frame to provide load bearing support for the structure, securing members being provided between the frame assembly and the building, weather seals being provided between the room structure assembly and the building, securement members for securing the panels to the frame assembly and to each other, and weather seals defined between the panels and the panels and the frame assembly, to thereby provide a sturdy, at least partially pre-constructed, economical, and thermally efficient room addition structure.

BRIEF DESCRIPTION OF THE DRAWINGS

One particular embodiment of the present invention is illustrated in the accompanying drawings wherein.

DETAILED DESCRIPTION OF THE PREFERRED EMBODIMENT

Figure 1:
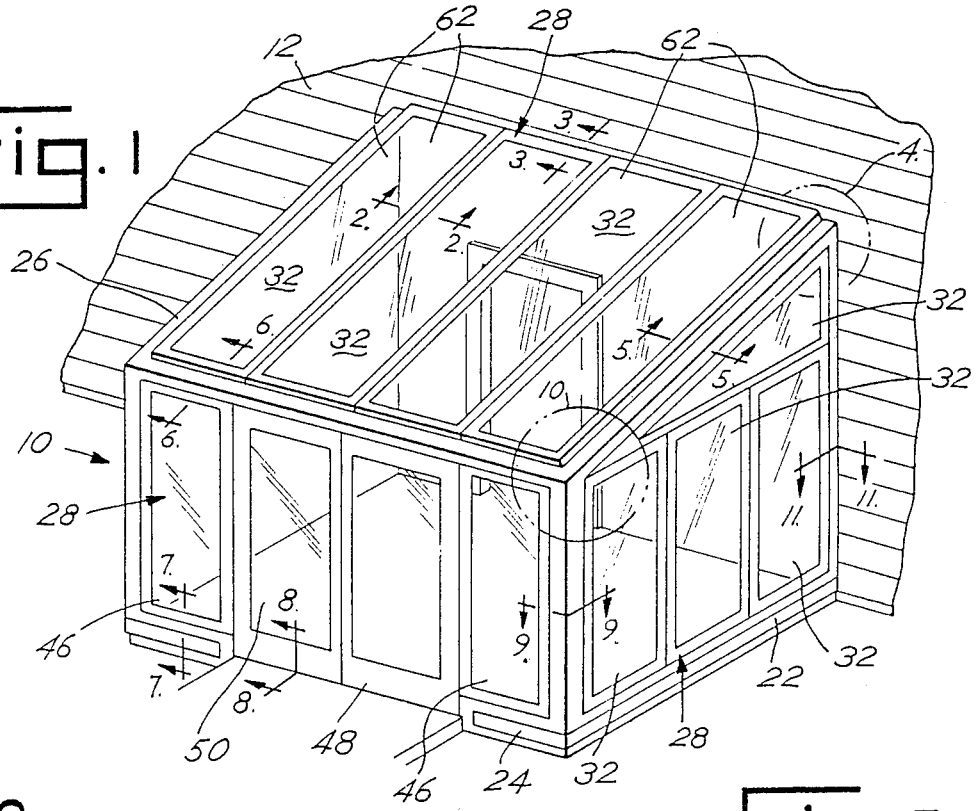
FIG. 1 is a perspective view of a preferred room addition assembly, which is attached to the exterior wall on an existing building, such as a residence.
Figure 12:
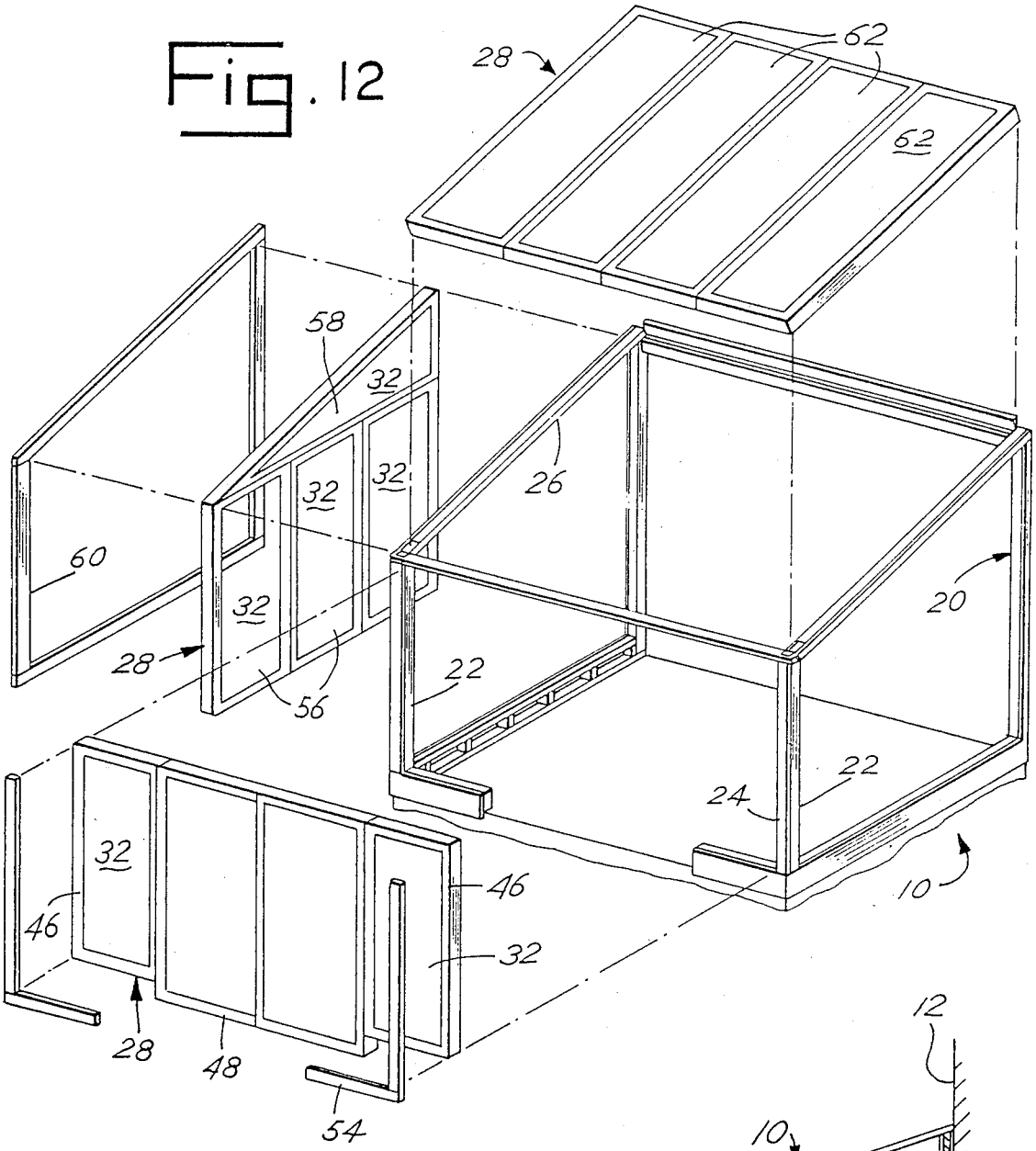
FIG. 12 is an exploded pictorial view of the embodiment of FIG. 1.
Figure 13:
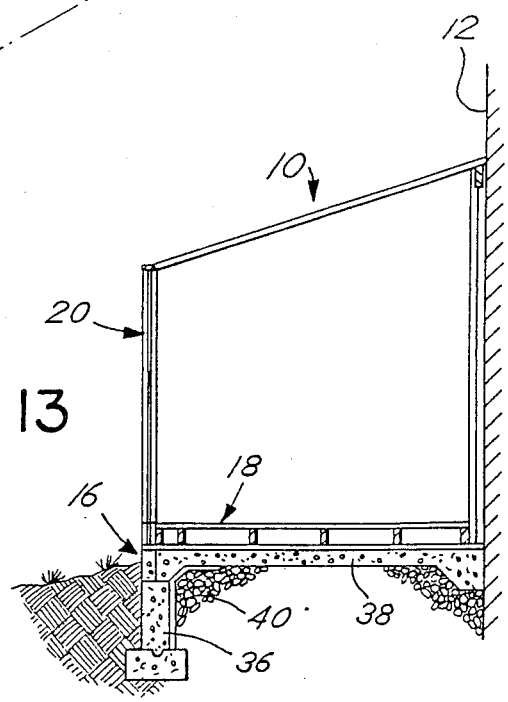
FIG. 13 is a transverse sectional view through the room structure assembly of FIG. 1.
Figure 14:
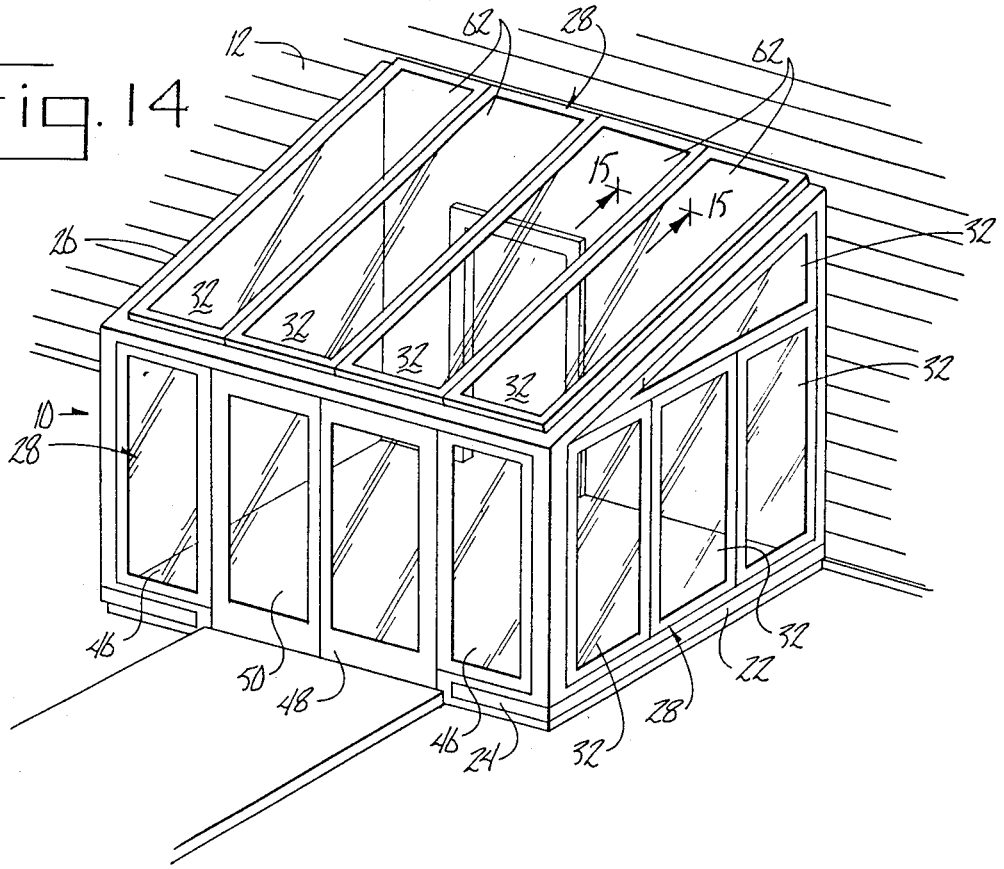
FIG. 14 is a view similar to FIG. 1 of an alternative preferred room addition assembly.

With reference, in particular, to FIGS. 1, 12, and 13, a unique room addition structure, generally 10, is shown attached to and against the exterior wall 12 of an existing building. As seen best in FIG. 1, a doorway or opening is provided in the wall 12 in order to provide for access between the interior of the building and the interior of the room assembly 10.

The room structure assembly 10 includes, generally, a foundation, generally 16, a floor assembly, generally 18, an upright frame assembly, generally 20, which is mounted on the foundation 16 and floor assembly 18, the frame assembly 20 including a pair of spaced side wall frame portions 22, a front wall frame portion 24, and a roof frame portion generally 26; the assembly 10 further includes a plurality of structurally independent panel members, each of which is generally designated 28, it being understood that the panel members 28 may be of varying size and shape in the same assembly 10; a major proportion of the panel members 28 are comprised of window assemblies having glazing panels provided therein. The window units are generally of a casement type or of a double hung type, although, in the drawings, the window units in the outer walls are generally shown as casement units.

It is important that at least some window units are provided within the roof frame 26; the panel members 28 and the frame assembly 20 are cooperatively constructed and arranged to provide for load bearing support for the entire assembly 10. As generally shown in FIG. 1 and in greater detail in FIGS. 2–11, various securement members, generally designated 30, and suitable seals are provided for securing the panel membes 28 to each other and to the frame assembly 20.

Because of difficulty in illustration, the securing members, generally screws or nails, and the sealing elements, principally a sealing mastic, are not shown. The various elements that comprise weather seals, such as mullions or flashings, are, however, shown generally.

It is to be understood that the embodiment of the room assembly 10, as shown in the accompanying drawings and to be hereinafter described in detail, is illustrative of one preferred embodiment of the invention. In particular, the structural details of the panel members 28 may vary over a wide range. The panel members shown in the accompanying drawings are shown as window units generally 32. However, it is to be understood that the panels 28 may be unglazed panels. It is important, however, that the structure 10 is to use a high proportion of glazed panels 32 and that at least some of the panels mounted in the roof frame 26 are to be of glazed window units 32. In essence, the more glazing that there is provided in the structure 10, the greater is the effect of solar energy for heating the room, that is, the greater the value of passive solar energy.

Although, in its simplest form, the room assembly 10 uses no heating source other than passive solar energy, it is to be understood that, for greater comfort, a heating system and/or air conditioning system may be used in connection with the assembly 10. The window units are also preferably double glazed. Similarly, and as schematically shown, for example, in FIG. 6, an adjustable slat shade assembly, generally 34, may be used in connection with the 32 in order to reduce the amount of solar energy which is passed into the interior of the room assembly 10.

In the room structure 10, it is one of the important features that the panel members 28 cooperate with the frame assembly 20 in order to provide for load bearing support for the entire assembly 10, both in the side walls and in the roof. In most known constructions, the window frame assemblies do not provide load bearing support for the building in which they are placed. This particular aspect of the assembly 10 provides for not only economical construction, but also greatly simplifies the construction while retaining high quality. Much of the structural detail of the assembly 10 is conventional and well known to those skilled in the art. In essence, it is the overall combination of elements, as described, which provides the unique advantages of the invention.

Referring, in particular, to FIG. 13, the foundation 16 includes footings 36 which are placed below the frost line. A concrete subfloor 38 is poured in place adjacent the wall 12 of the building to which the assembly 10 is attached, with the footings 36 being located around the periphery of the floor 38. A rough floor is secured in a conventional manner to the cement floor 38 and is secured in place by conventional methods.

Insulating material 40, as needed, is placed in the space between the footings 36 and beneath the subfloor 38. A sheathing (not shown) is located on the exterior wall 12 of the building, to which the room assembly 10 is attachably secured. Although the size of the room assembly, that is, the length and width of the floor plan of the room may vary over a wide range, using conventional structural lumber, such as 2 x 4 framing members and when using conventional window units 32, whether of the casement type or of the double hung type, the room may vary in length between 1–19 feet and in width between 7–8 feet, with the width extending from the wall outwardly from the front frame 24. The slope of the roof may also vary although a conventional 4/12, 5/12 or 6/12 roof pitch is generally used.

Figure 3:
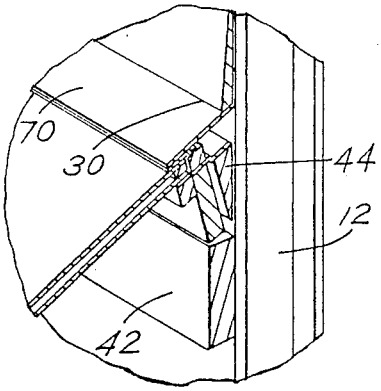
FIG. 3 is an enlarged, pictorial sectional view taken along the line 3—3 of FIG. 1 illustrating a seal-securing arrangement between the roof and the exterior wall of the building to which the room structure is attached.

Referring to FIG. 3, a bearing plate 42 and nailing wedge 44 are secured to the wall 12 by nails or screws and act to support the rear upper edge of the roof frame 26 with the panel members 28 which define the roof assembly. As seen, the nailing wedge 44 is secured in place immediately above the transversely, and horizontally mounted bearing plate 42.

Figure 8:
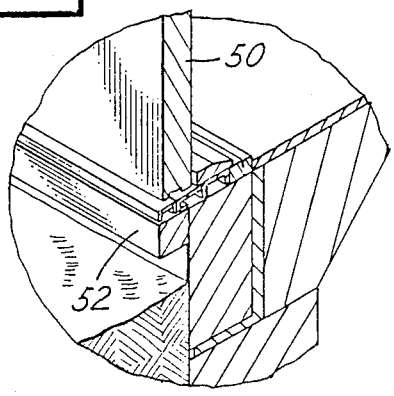
FIG. 8 is an enlarged, pictorial sectional view taken along the line 8—8 of FIG. 1; illustrating the bottom of a sliding door assembly.

Preferably, the panel members 28 in the front frame 24 include a pair of oppositely spaced fixed window units 46 and a sliding door unit 48. The sliding door unit 48 includes a sliding door portion 50 in which the upper side, and lower side, as seen in FIG. 8, are guided in a lower guide track 52. As seen in FIG. 12, an outer blocking frame 54 secures the window units 46 and sliding door units 48 rigidly in place to the front wall frame portion 24.

As with the window units 46 and sliding door unit 48, a pair of window units, including a plurality of generally upright window units 56 and an upper wedge shaped glazing unit 58, are rigidly secured to the opposite side frames 22 and are secured in place therein by side wall blocking frames 60, as best seen in FIG. 12. Although the window units 56 may be either casement or double hung type of units, the wedge shaped unit 58 is fixed.

Figure 2:
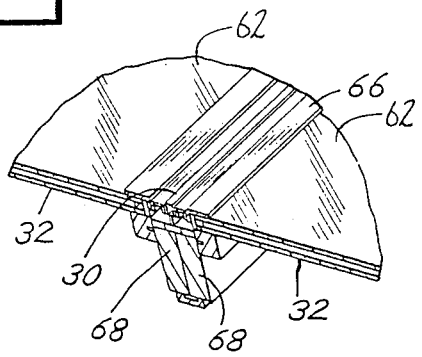
FIG. 2 is an enlarged, pictorial sectional view taken along the line 2—2 of FIG. 1, illustrating a typical sealing and securing arrangement between adjacent window frames.

A plurality of sun roof units 62 extend transversely outwardly and downwardly from the wall 12 to the intersection of the roof frame 26 with the front frame 24. A mastic type caulking material (not shown) is placed between abutting edges of the frames of the roof unit 62, as best seen in FIG. 2, as well as between the window frames and the roof frame. The roof units 62 are of unitary construction and are in abutting relationship. Desirably, the roof units in particular have slat shades mounted therein, either between a pair of spaced glazing panels (manufactured under the trademark SLIMSHADE) or alternatively, adjacent the underside of one of the glazing panels of the sunroof window unit 62.

A mullion cover 66 as best seen in FIG. 2, preferably of an extruded metal material, is secured in place over the joint between the abutting units 62. The mullion cover 66 also acts to protect the mastic sealing material which is sealably compressed between the lateral edges 68 of the window units 62. This arrangement protects the sealing material from the sun to thereby extend the life of the mastic.

Figure 15:
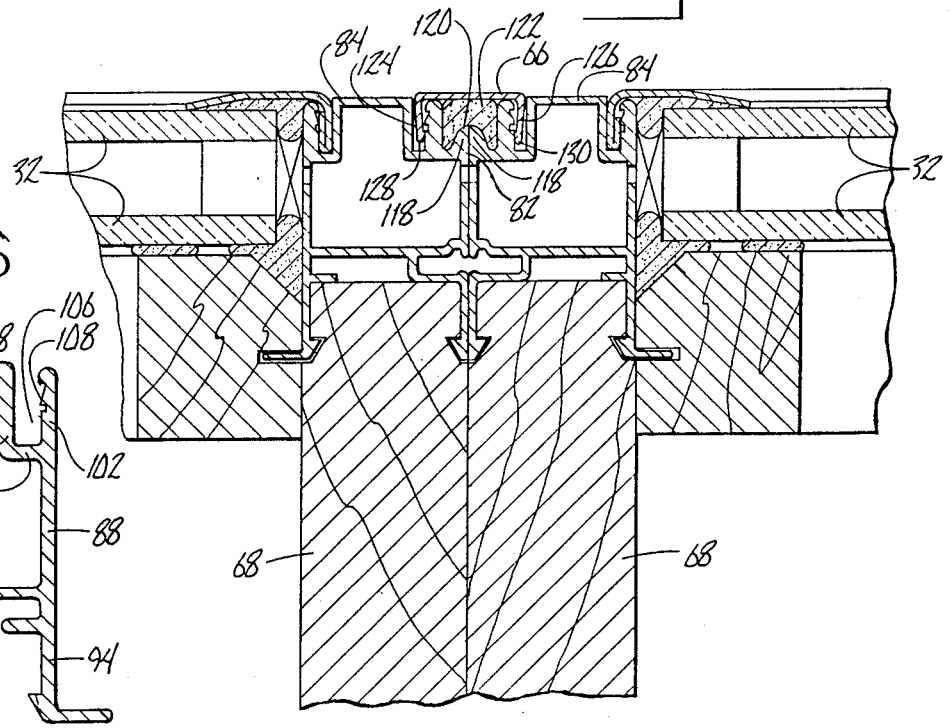
FIG. 15 is an enlarged, sectional view taken along the line 15—15 of FIG. 14, illustrating a preferred sealing and securing arrangement between adjacent window frames.
Figure 16:
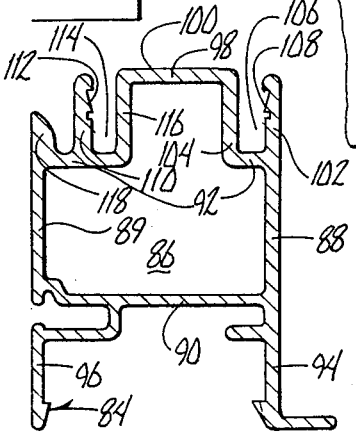
FIG. 16 is a sectional view of an isolated one of the glazing flanges of the arrangement of FIG. 15.

As most preferred, the mullion cover 66 is secured in place over a joint 82 between two glazing flanges 84 of the abutting units 62, as shown in FIG. 15. The flanges 84 are mirror images of each other, and as best seen in FIG. 16, each includes a central, box-like portion 86. Two thin, upright, parallel wall sections 88, 89 form the sides of the central portion 86, and are joined by a perpendicular, lower wall section 90, and a thin, shaped, upper wall section 92. Two legs 94, 96 extend below the lower wall section 90. The leg 94 is attached to the juncture of the wall sections 88, 90, while the leg 96 is attached to the lower wall section 90 between the wall sections 88, 89.

The upper wall section 92 includes an upwardly thrust U-shaped portion 98 with an exposed surface 100. A first serrated arm 102 projects upward from the juncture of the wall sections 88, 92 to a height just less than the surface 100. The arm 102 and side 104 of the U portion 98 form a first recess 106, which the serrations 108 of the arm 102 face. A second serrated arm 110 with serrations 112 forms a second recess 114 with the opposite side 116 of the U portion 98. The arm 110 is spaced from the juncture of the wall sections 89, 92.

A quarter-round nib 118 projects upward from the juncture of the wall sections 89, 92 to a height reduced from that of the arms 102, 110 and U portion 98.

As in FIG. 15, flanges 84 are abutted with nibs 118 touching, thereby forming a mastic channel 120 above the nibs 118 between the arms 110. Mastic 122 is placed in the mastic channel 120. The mastic filled channel 120 is then covered by the mullion cover 66, which has downwardly extending legs 124, 126 with barbs 128, 130 fitted, respectively, in the recesses 114 and held in tension by the serrations 112.

The channel 120 has a bottom surface formed by the nibs 118 which has an inverted U shape. Thus, the mastic 122 in the channel 120 has a central, shallow neck and deeper, non-central, downwardly directed ridges. The ridges anchor the mastic 122 to the flanges 84, in the event of tension tending to separate the flanges 84. This anchoring action results in tension stretching the neck, rather than breaking the mastic free of the flanges 84. To prevent the tension of the mullion cover 66 from causing rotation of the flanges 84 upward about the mullion cover 66, the bottom of the channel 120 below the mastic ridges is raised above the bottoms of the recesses 114.

Figure 4:
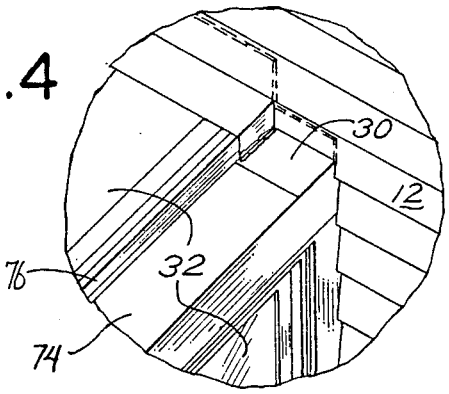
FIG. 4 is an enlarged, pictorial view, of view 4 of FIG. 1, illustrating an upper, inner corner of the room structure of FIG. 1.

As seen in FIG. 3, a top flashing 70 is secured in place at the junction between the rear edge of the roof on the wall 12 in order to provide for the sealing relationship therebetween. Flashing 72, as best seen in FIG. 4, is located at the intersection of the side wall, the roof, and the wall 12.

Figure 5:
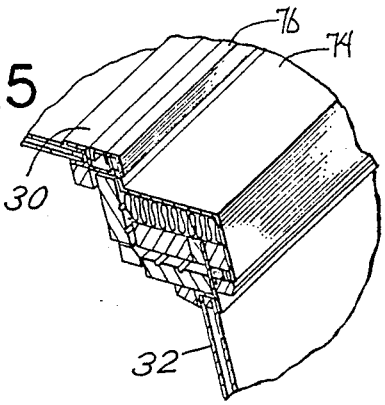
FIG. 5 is an enlarged pictorial sectional view taken along the line 5—5 of FIG. 1, illustrating an outer edge of the roof of the room assembly.

In FIG. 5, it is seen that a sunroof side flashing 74 and a counter flashing 76 are secured in place over the lateral edges of the roof of the assembly 10.

Figure 6:
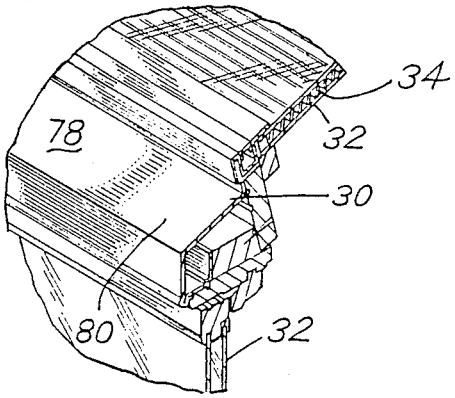
FIG. 6 is an enlarged, pictorial sectional view taken along the line 6—6 of FIG. 1, illustrating the outer lower corner of the roof of the structure of FIG. 1.
Figure 7:
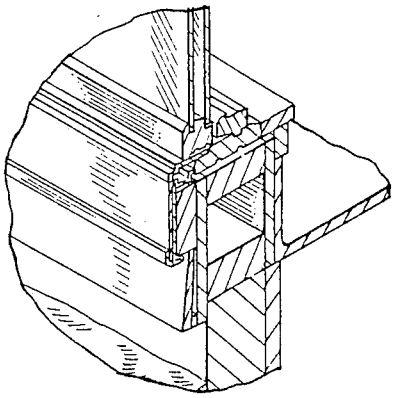
FIG. 7 is an enlarged, pictorial sectional view taken along the line 7—7 of FIG. 1; illustrating a typical bottom of a wall portion along the foundation.
Figure 9:
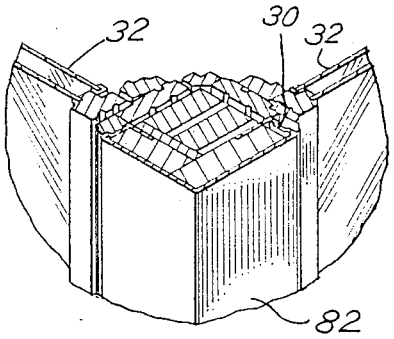
FIG. 9 is an enlarged, pictorial sectional view taken along the line 9—9 of FIG. 1, illustrating the front upright corner of the room assembly.
Figure 10:
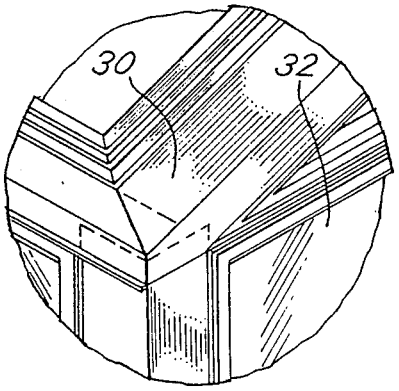
FIG. 10 is an enlarged, pictorial view of view 10 of FIG. 1, illustrating an outer corner of the roof assembly.
Figure 11:
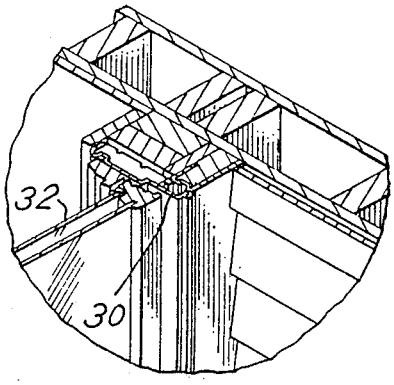
FIG. 11 is an enlarged pictorial setional view taken along the line 11—11 of FIG. 1 illustrating the rear upright corner of the assembly where it attaches to the building.

Referring to FIG. 6, a counter flashing 78 is secured in place along the outer lower edge of the roof assembly. A bottom flashing 80 is similarly secured in place below the flashing 78. A pair of upright mullion covers 82 cover the outer upright exterior corners of the frame assembly 20, as best seen in FIG. 9.

In installing the various flashings and mullions, caulking is applied in order to provide for a weather-tight seal between the various flashings or mullion covers and the frame itself. The structural details in the applicant's invention result in a unique combination of structural elements which, although of generally conventionnal construction and during construction employ known techniques, provide the unique advantages previously set forth.

While in the foregoing there has been provided a detailed description of a particular embodiment of the present invention, it is to be understood that all equivalents obvious to those having skill in the art are to be included within the scope of the invention as claimed.

What I claim and desire to secure by Letters Patent is:

1. A room structure for attachment to the exterior wall of a building, comprising:

an upright frame assembly mounted on a foundation adjacent said wall and including an elongated outer wall frame portion spaced outwardly from said wall, a pair of spaced apart side wall frame portions extending between said wall and said outer wall frame portion at each end thereof, and a roof frame portion extending between said wall and said outer wall frame portion at the upper end thereof and between said side wall frame portions at the upper ends thereof, means for securing said frame assembly to said building, a plurality of structurally independent glazing panel units securely mounted within at least one of said frame portions, means for securing adjacent panel units to each other, including an elongated glazing flange mounted on the edges of each panel unit such that said flanges of adjacent units abut one another along their lengths to form an open mastic channel between the abutting flanges for receiving mastic, and a mullion cover lockingly engaging said flanges and covering said mastic channel, said glazing flange including an upper wall, a lower wall, and opposite side walls extending between said upper and lower walls, a pair of lower legs extending from said lower wall for attaching said flange to said panel unit, a first arm extending upwardly from one of said side walls, a second arm spaced inwardly from the other of said side walls and extending upwardly from said upper wall, and a rib extending upwardly from the other of said side walls so as to form a recess between said rib and said second arm.

2. The assembly of claim 1 wherein said glazing flange further includes a raised portion extending upwardly from said upper wall between said first and second arms, said raised portion including opposite side walls extending upwardly from said upper wall of said glazing flange and a top wall interconnecting said opposite side walls, said side walls of said raised portion being spaced apart from said first and second arms of said glazing flange and extending slightly above said first and second arms such that said top wall is substantially coplanar with said joint cap.

3. The room structure of claim 1 wherein said mullion cover snap fits said second arms of said abutting glazing flanges.

4. The room structure of claim 1 wherein said mullion cover has spaced apart downwardly extending legs for overlapping engaging said second arms of said glazing flanges.

5. The room structure of claim 4 wherein said glazing flange arms have serrations therein and said mullion cover legs each have a barb thereon for matingly engaging said serrations of said glazing flange second arms.

6. A room structure for attachment to the exterior wall of a building, comprising:

an upright frame assembly mounted on a foundation adjacent said wall and including an elongated outer wall frame portion spaced outwardly from said wall, a pair of spaced apart side wall frame portions extending between said wall and said outer wall frame portion at each end thereof, and a roof frame portion extending beteen said wall and said outer wall frame portion at the upper end thereof and between said side wall frame portions at the upper ends thereof, means for securing said frame assembly to said building, a plurality of structurally independent glazing panel units securely mounted within at least one of said frame portions, means for securing adjacent panel units to each other, including an elongated glazing flange mounted on the edges of each panel unit such that said flanges of adjacent units abut one another along their lengths to form an open mastic channel between the abutting flanges for receiving mastic, and a mullion cover lockingly engaging said flanges and covering said mastic channel, said mastic channel having a shallow central portion and deeper opposite outer side portions for anchoring said mastic to said flanges, such that said mastic in said mastic channel adheres to said flanges along said outer side portions so as to mechanically lock said flanges together and such that said mastic is stretchable at said central portion of said mastic channel without impairing said adhesion to said flanges.

7. The room structure of claim 6 wherein said glazing flanges are mirror images of one another in cross-section.

8. A glazing flange assembly for securing adjacent glazing panel units to each other, comprising:

an elongated glazing flange mounted on the edges of each panel unit such that said flanges of adjacent units abut one another along their lengths to form an open mastic channel between said abutting flanges for receiving mastic, and a mullion cover lockingly engaging said flanges and covering said mastic channel, said glazing flange including an upper wall, a lower wall, and opposite side walls extending between said upper and lower walls, a pair of lower legs extending from said lower wall for attaching said flange to said panel unit, a first arm extending upwardly from one of said side walls, a second arm spaced inwardly from the other of said side walls and extending upwardly from said upper wall, and a rib extending upwardly from the other of said side walls so as to form a recess between said rib and said second arm.

9. A glazing flange assembly for securing adjacent glazing panel units to each other, comprising:

an elongated glazing flange mounted on the edges of each panel unit such that said flanges of adjacent units abut one another along their lengths to form an open mastic channel between said abutting flanges for receiving mastic, and a mullion cover lockingly engaging said flanges and covering said mastic channel, said glazing flange including an upper wall and opposite side walls, a first arm extending upwardly from said upper wall, a second arm spaced inwardly from one of said side walls and extending upwardly from said upper wall, and a rib extending upwardly from said one side wall so as to form a recess between said rib and said second arm.

10. The assembly of claim 9 wherein said mullion cover snap fits said second arms of said abutting glazing flanges.

11. The assembly of claim 9 wherein said mullion cover has spaced apart downwardly extending for overlappingly engaging said second arms of said glazing flanges.

12. The assembly of claim 11 wherein said glazing flange arms have serrations therein and said mullion cover legs each have a barb therealong for matingly engaging said serrations of said glazing flange second arms.

13. The assembly of claim 9 wherein said mastic channel has a shallow central portion and deeper opposite outer side portions for anchoring said mastic to said flanges.

14. The assembly of claim 13 wherein mastic in said mastic channel adheres to said flanges along said outer ridge portions so as to mechanically lock said flanges together.

15. The assembly of claim 14 wherein said mastic stretches at said central portion of said mastic channel without impairing said adhesion to said flanges.

16. The assembly of claim 16 wherein said glazing flanges are mirror images of one another in cross-section.

17. The assembly of claim 9 wherein said glazing flange further includes a raised portion extending upwardly from said upper wall between said first and second arms, said raised portion including opposite side walls extending upwardly from said upper wall of said glazing flange and a top wall interconnecting said opposite side walls, said side walls of said raised portion being spaced apart from said first and second arms of said glazing flange.

18. The assembly of claim 9 wherein said glazing flange further includes a raised portion extending upwardly from said upper wall between said first and second arms, said raised portion including opposite side walls extending upwardly from said upper wall of said glazing flange and a top wall interconnecting said opposite side walls, said side walls of said raised portion being spaced apart from said first and second arms of said glazing flanges and extending slightly above said first and second arms such that said top wall is substantially coplanar with said mullion cover.

19. A glazing flange assembly for securing adjacent glazing panel units to each other, comprising:

an elongated glazing flange mounted on the edges of each panel unit such that said flanges of adjacent units abut one another along their lengths to form an open mastic channel between said abutting flanges for receiving mastic, and a mullion cover lockingly engaging said flanges and covering said mastic channel, said glazing flange including an upper wall and opposite side walls, a first arm extending upwardly from one of said side walls, a second arm spaced inwardly from the other of said side walls and extending upwardly from said upper wall, and a rib extending upwardly from the other of said side walls so as to form a recess between said rib and said second arm.

20. The assembly of claim 19 wherein said glazing flange further includes a raised portion extending upwardly from said upper wall between said first and second arms, said raised portion including opposite side walls extending upwardly from said upper wall of said glazing flange and a top wall interconnecting said opposite side walls, said side walls of said raised portion being spaced apart from said first and second arms of said glazing flange.

21. The assembly of claim 19 wherein said glazing flange further includes a raised portion extending upwardly from said upper wall between said first and second arms, said raised portion including opposite side walls extending upwardly from said upper wall of said glazing flange and a top wall interconnecting said opposite side walls, said side walls of said raised portion being spaced apart from said first and second arms of said glazing flange and extending slightly above said first and second arms such that said top wall is substantially coplanar with said mullion cover.

22. A glazing flange assembly for securing adjacent glazing panel units to each other, comprising:

an elongated glazing flange mounted on the edge of each panel unit, each of said flanges including an outer side wall, an upper wall extending inwardly from said side wall, a rib extending upwardly from said side wall and a first arm extending upwardly from said upper wall and spaced inwardly from said rib so as to define a first recess therebetween;

said flanges being mirror images of one another and said outer side walls of said flanges abutting one another such that said ribs, said first arms and said first recesses cooperate to form an open mastic channel for receiving mastic material; and a mullion cover lockingly spanning and overlapping said first arms of said abutting flanges thereby covering said mastic channel.

23. The assembly of claim 22 wherein said channel is substantially filled with mastic material, and said mastic channel has opposite side portions adjacent said first arms and a central portion above said ribs, said first arms extending upwardly further than said ribs such that said side portions have a greater depth than said central portion thereby allowing said mastic material to stretch upon movement of said panels without breaking the adhesion of said mastic material to said mastic channel.

24. The assembly of claim 22 wherein said mullion cover includes opposite downwardly extending legs and a web interconnecting said legs, and said flanges each have a first wall extending upwardly from said upper wall and spaced inwardly from said firt leg to define a second recess for receiving one of said legs of said mullion cover.

25. The assembly of claim 24 wherein each of said flanges has a raised top wall extending inwardly from said first wall and being substantially coplanar with said web of said mullion cover.

26. The assembly of claim 25 wherein each of said flanges has a second wall extending downwardly from said top wall to said upper wall, said first wall, top wall and second wall forming a raised portion of said flange.

27. The assembly of claim 26 wherein each of said flanges includes a second arm extending upwardly from said upper wall and spaced inwardly from said second wall so as to define a third recess therebetween adapted to receive a portion of said glazing panel unit.

28. A glazing flange assembly for securing adjacent glazing panel units to each other, comprising:

an elongated glazing flange mounted to the edge of each panel unit, each of said flanges including an outer side wall, an upper wall extending inwardly from said side wall, and a first arm extending upwardly from said upper wall and spaced inwardly from said side wall;

said flanges being mirror images of one another and said outer side walls of said flanges abutting one another so as to form an open mastic channel between said first arms containing mastic material, said mastic channel having opposite side portions adjacent said first arms and a central portion between said side portions;

a mullion cover lockingly spanning and overlapping said first arms of said abutting flanges thereby covering said mastic channel; and means for reducing the cross-sectional depth of said central portion of said mastic channel with respect to the depth of said side portions of said mastic channel thereby making the mastic material thinner in the central portion relative to said side portions and allowing said mastic material to stretch in response to movement of said panels without breaking the adhesion between said mastic material and said mastic channel.

29. The assembly of claim 28 wherein said means includes a rib extending upwardly from said outer side wall of each flange and spaced outwardly from said first arm so as to define one of said side portions of said mastic channel therebetween, said ribs of said flanges abutting one another so as to define said central portion of said mastic channel thereabove.

* * * * *